US008466759B2

(12) United States Patent
Takaya et al.

(10) Patent No.: US 8,466,759 B2
(45) Date of Patent: Jun. 18, 2013

(54) REVERSIBLE ELECTROMAGNETIC CONTACTOR

(75) Inventors: Kouetsu Takaya, Kounosu (JP); Koji Okubo, Kounosu (JP); Yasuhiro Naka, Kounosu (JP); Kenji Suzuki, Kounosu (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/508,254

(22) PCT Filed: Sep. 13, 2010

(86) PCT No.: PCT/JP2010/005587
§ 371 (c)(1), (2), (4) Date: Jun. 12, 2012

(87) PCT Pub. No.: WO2011/117938
PCT Pub. Date: Sep. 29, 2011

(65) Prior Publication Data

US 2013/0002381 A1 Jan. 3, 2013

(30) Foreign Application Priority Data

Mar. 26, 2010 (JP) ..... 2010-072185

(51) Int. Cl.
*H01H 73/12* (2006.01)

(52) U.S. Cl.
USPC ..... 335/17; 335/202

(58) Field of Classification Search
USPC ..... 335/17
See application file for complete search history.

(56) References Cited

U.S. PATENT DOCUMENTS

| | | | | |
|---|---|---|---|---|
| 5,241,290 | A * | 8/1993 | Sehmer et al. | 335/202 |
| 2012/0249271 | A1* | 10/2012 | Naka et al. | 335/202 |
| 2012/0268224 | A1* | 10/2012 | Naka et al. | 335/202 |
| 2012/0280771 | A1* | 11/2012 | Takaya et al. | 335/160 |

FOREIGN PATENT DOCUMENTS

| | | | |
|---|---|---|---|
| EP | 0 388 823 | B1 | 3/1995 |
| JP | S49-88259 | U | 7/1974 |
| JP | H03-266325 | A | 11/1991 |
| JP | H06-076719 | A | 3/1994 |

* cited by examiner

*Primary Examiner* — Elvin G Enad
*Assistant Examiner* — Lisa Homza
(74) *Attorney, Agent, or Firm* — Manabu Kanesaka

(57) ABSTRACT

A reversible unit (10) is attached by being mounted over a pair of adjacently disposed electromagnetic contactors (1*a*) and (1*b*). The reversible unit (10) includes a pair of interlock plates (11) and (12), a lock piece (13), and a unit case (10b) accommodating the pair of interlock plates (11) and (12) and the lock piece (13). The lock piece (13) rotates in a first direction with the movement of one of the interlock plates (12) in a turn-on operation of one of the electromagnetic contactors (1*a*) to prevent the movement of the other interlock plate (11), and rotates in a second direction different from the first direction with the movement of the other interlock plate (11) in a turn-on operation of the other electromagnetic contactor (1*b*) to prevent the movement of one of the interlock plates (12). The unit case (10*b*) is provided with a lock piece display window (10*g*) which allows determination of the rotation of the lock piece (13) in the first direction or the second direction.

3 Claims, 10 Drawing Sheets

REVERSIBLE ELECTROMAGNETIC CONTACTOR

RELATED APPLICATIONS

The present application is National Phase of International Application No. PCT/JP2010/005587 filed Sep. 13, 2010, and claims priority from Japanese Application No. 2010-072185, filed Mar. 26, 2010.

TECHNICAL FIELD

The present invention relates to a reversible electromagnetic contactor in which a reversible unit is attached by being mounted over two adjacently disposed electromagnetic contactors.

BACKGROUND ART

For example, as a reversible electromagnetic contactor which is connected to a feeder circuit of an induction motor to control a forward/reverse operation of the induction motor, there is known a device in which a reversible unit is attached by being mounted over two adjacently disposed electromagnetic contactors, and the reversible unit mechanically locks a simultaneous turn-on operation (simultaneous ON operation) of the two electromagnetic contactors (e.g., Patent Document 1).

Each of FIGS. 9 and 10 shows a conventional reversible electromagnetic contactor similar to Patent Document 1.

As shown in FIG. 9, in two adjacently disposed electromagnetic contactors 1*a* and 1*b*, display windows 3*a* and 3*b* are provided in arc extinguishing covers 2*a* and 2*b*, and operation display pieces 4*a* and 4*b* protrude in the display windows 3*a* and 3*b* from internal portions of the devices.

As shown in FIG. 10, the operation display piece 4*a* of one of the electromagnetic contactors 1*a* is a member which is fixed to a movable contact support 4 disposed inside the electromagnetic contactor 1*a* and extends into the display window 3*a*, and the operation display piece 4*b* of the other electromagnetic contactor 1*b* is also a member which is fixed to a movable contact support disposed inside the electromagnetic contactor 1*b* and extends into the display window 3*b*, though not shown.

As shown in FIG. 9, a reversible unit 6 has a unit bottom plate 6*a* which is connected to the arc extinguishing covers 2*a* and 2*b* by being mounted over the two electromagnetic contactors 1*a* and 1*b*, and a unit cover 6*b* which has a peripheral edge portion to be engaged with that of the unit bottom plate 6*a*, and a first interlock plate 6*c*, a second interlock plate 6*d*, and a lock piece 6*e* which constitute a lock mechanism are mutually rotatably connected to each other in the internal space of the unit bottom plate 6*a* and the unit cover 6*b*. On the back surfaces on end portion sides of the first and second interlock plates 6*c* and 6*d*, there are formed tubular connection pieces 6*f* and 6*g* which protrude to the outside through opening portions 6*h* and 6*i* formed in the bottom plate 6*a*. In addition, on the front surfaces on the end portion sides of the first and second interlock plates 6*c* and 6*d*, there are formed reversible unit operation display pieces 6*k* and 6*m* which protrude into a pair of display windows 6*n* and 6*p* formed in the unit cover 6*b*.

A plurality of hook portions 6*j* is formed on the unit bottom plate 6*a*, a plurality of engagement holes 2*c* corresponding to the individual hook portions 6*j* is also formed in the arc extinguishing covers 2*a* and 2*b*, and the plurality of hook portions 6*j* is detachably engaged with the corresponding engagement holes 2*c* when the unit bottom plate 6*a* contacts with the arc extinguishing covers 2*a* and 2*b*.

The connection pieces 6*f* and 6*g* of the reversible unit 6 are connected to the head portions of the operation display pieces 4*a* and 4*b* of the two electromagnetic contactors 1*a* and 1*b* in fitting relation, the lock piece 6*e* rotates one of the first and second interlock plates 6*c* and 6*d* while regulating the rotation of the other interlock plate, and only one of the operation display pieces 4*a* and 4*b* is allowed to move, whereby a simultaneous turn-on operation of the two electromagnetic contactors 1*a* and 1*b* is mechanically locked.

Patent Document 1: Japanese Patent Application Publication No. H3-266325

DISCLOSURE OF THE INVENTION

In an induction motor in which the reversible electromagnetic contactor having the above-described structure is connected to a feeder circuit, the determination of a forward operation or a reverse operation is performed by checking the positions of the reversible units 6*k* and 6*m* which protrude into the display windows 3*a* and 3*b* of the reversible unit 6.

However, unless the connection state of the two electromagnetic contactors 1*a* and 1*b* constituting the reversible electromagnetic contactor is known, it is not possible to easily determine the forward operation or the reverse operation of the induction motor by merely looking at the positions of the reversible units 6*k* and 6*m* of the display windows 3*a* and 3*b*.

In view of the foregoing, the present invention has been achieved by focusing on the unsolved problem of the above-described conventional art, and an object thereof is to provide a reversible electromagnetic contactor including a reversible unit capable of easily determining which one of two electromagnetic contactors is in a turn-on operation.

In order to achieve the foregoing object, a reversible electromagnetic contactor according to an embodiment is a reversible electromagnetic contactor in which a pair of electromagnetic contactors is adjacently disposed such that respective operation display pieces which protrude on upper surfaces move in an identical direction at a time of a turn-on operation, and a reversible unit is attached by being mounted over the upper surfaces of the pair of electromagnetic contactors, wherein the reversible unit includes a pair of interlock plates which is detachably connected to the operation display pieces of the pair of electromagnetic contactors, a lock piece which is connected between the pair of interlock plates, and a unit case which accommodates the pair of interlock plates and the lock piece, and is attached by being mounted over the upper surfaces of the pair of electromagnetic contactors, the lock piece rotates in a first direction with a movement of one of the interlock plates in a turn-on operation of one of the electromagnetic contactors to prevent a movement of the other interlock plate and maintain a release operation of the other electromagnetic contactor, and rotates in a second direction different from the first direction with the movement of the other interlock plate in a turn-on operation of the other electromagnetic contactor to prevent a movement of the one of the interlock plates and maintain a release operation of the one of the electromagnetic contactors, and the unit case is provided with a lock piece display window which allows determination of the rotation of the lock piece in the first direction or the second direction.

According to the reversible electromagnetic contactor according to the embodiment, since the lock piece of the reversible unit rotates in the first direction with the movement of one of the interlock plates in the turn-on operation of one of the electromagnetic contactors to prevent the movement of the other interlock plate and maintain the release operation of the other electromagnetic contactor, and rotates in the second direction different from the first direction with the movement of the other interlock plate in the turn-on operation of the other electromagnetic contactor to prevent the movement of one of the interlock plates and maintain the release operation of one of the electromagnetic contactors, it is possible to reliably prevent the pair of electromagnetic contactors from being simultaneously brought into a turned-on state.

In addition, when the lock piece display window of the reversible unit is looked at, since it is possible to determine that one of the electromagnetic contactors is performing the turn-on operation from the rotation of the lock piece in the first direction, or determine that the other electromagnetic contactor is performing the turn-on operation from the rotation of the lock piece in the second direction, it is possible to easily determine the release state or the turned-on state of each of the pair of electromagnetic contactors. With this, in an induction motor in which the reversible electromagnetic contactor according to the embodiment is connected to a feeder circuit, only by looking at the direction of the rotation of the lock piece through the lock piece display window of the reversible unit, it is possible to easily determine the forward operation or the reverse operation of the induction motor.

In the reversible electromagnetic contactor according to the embodiment, on a surface of the unit case around the lock piece display window, there are displayed a first display portion which shows that the one of the electromagnetic contactors is in a turned-on state in a direction of the rotation of the lock piece in the first direction, and a second display portion which shows that the other electromagnetic contactor is in a turned-on state in a direction of the rotation of the lock piece in the second direction.

According to the reversible electromagnetic contactor according to the embodiment, only by looking at the first and second display portions displayed on the surface of the unit case, it is possible to easily determine which one of the pair of electromagnetic contactors is in the turned-on state.

In addition, in the reversible electromagnetic contactor according to the embodiment, the unit case and the lock piece are formed of members having different colors.

According to the reversible electromagnetic contactor according to the embodiment, it is possible to grasp the direction of the rotation of the lock piece with accuracy.

Further, in the reversible electromagnetic contactor according to the embodiment, the lock piece is a plate-like member having a substantially triangular shape in a plan view, each of a first top portion and a second top portion of the lock piece is rotatably connected to an end portion in a movement direction of each of the pair of interlock plates, and a third top portion of the lock piece is displayed to an outside from the lock piece display window, and an opening peripheral wall forming the lock piece display window is formed with a prevention wall contacting with a lock surface as a peripheral surface of the third top portion to prevent the movement of the other interlock plate or the one of the interlock plates when the lock piece rotates in the first direction or the second direction.

According to the reversible electromagnetic contactor according to the embodiment, since the opening peripheral wall of the lock piece display window which displays the third top portion of the lock piece functions as the prevention wall to the pair of interlock plates, it is possible to provide the inexpensive reversible unit with the simple structure without adding special components or adopting a complicated structure.

According to the reversible electromagnetic contactor according to the present invention, since the lock piece of the reversible unit rotates in the first direction with the movement of one of the interlock plates in the turn-on operation of one of the electromagnetic contactors to prevent the movement of the other interlock plate and maintain the release operation of the other electromagnetic contactor, and rotates in the second direction different from the first direction with the movement of the other interlock plate in the turn-on operation of the other electromagnetic contactor to prevent the movement of one of the interlock plates and maintain the release operation of one of the electromagnetic contactors, it is possible to reliably prevent the pair of electromagnetic contactors from being simultaneously brought into the turned-on state.

In addition, when the lock piece display window of the reversible unit is looked at, since it is possible to determine that one of the electromagnetic contactors is performing the turn-on operation from the rotation of the lock piece in the first direction, or determine that the other electromagnetic contactor is performing the turn-on operation from the rotation of the lock piece in the second direction, it is possible to easily determine the release state or the turned-on state of each of the pair of electromagnetic contactors. With this, in the induction motor in which the reversible electromagnetic contactor of the present invention is connected to the feeder circuit, only by looking at the direction of the rotation of the lock piece through the lock piece display window of the reversible unit, it is possible to easily determine the forward operation or the reverse operation of the induction motor.

MODE FOR CARRYING OUT THE INVENTION

Figure 1:
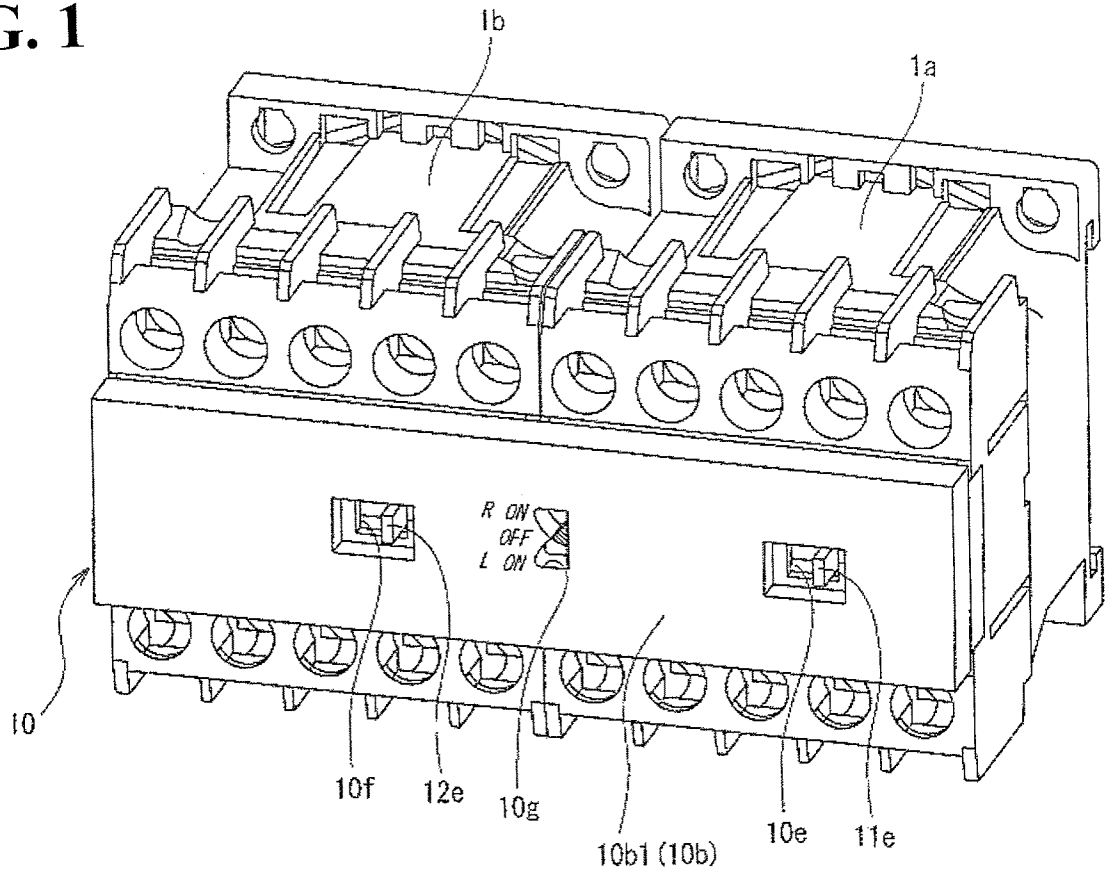
FIG. 1 is a perspective view showing a reversible electromagnetic contactor according to the present invention.

A detailed description is given hereinbelow of a best mode for carrying out a reversible electromagnetic contactor according to the present invention (hereinafter referred to as an embodiment) with reference to the drawings. Note that the description of components which are the same as those shown in FIGS. 9 and 10 will be omitted by retaining the same reference numerals.

In a reversible electromagnetic contactor of the present embodiment, as shown in FIG. 1, two electromagnetic contactors 1*a* and 1*b* are adjacently disposed, and a reversible unit 10 is attached by being mounted over the electromagnetic contactors 1*a* and 1*b*.

Figure 2:
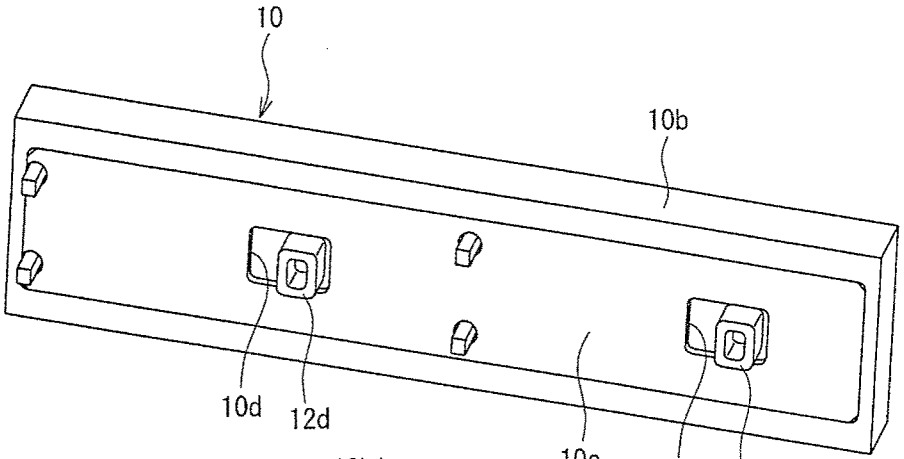
FIGS. 2(*a*) and 2(*b*) show a reversible unit constituting the reversible electromagnetic contactor according to the present invention.
Figure 2:
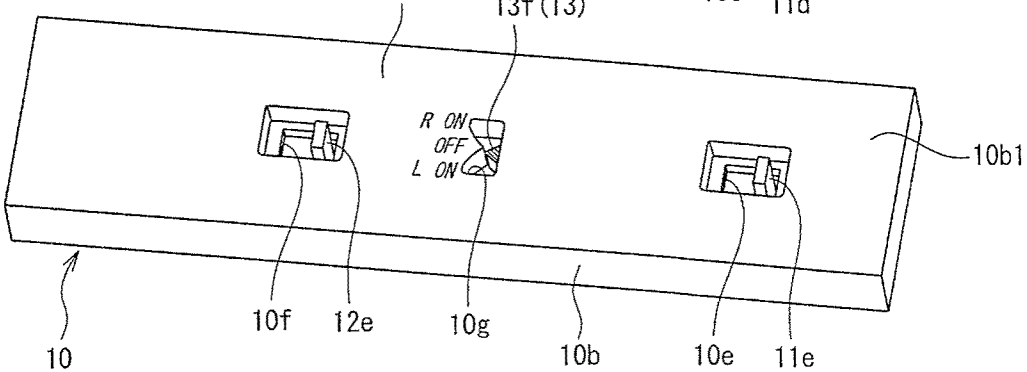
Figure 4:
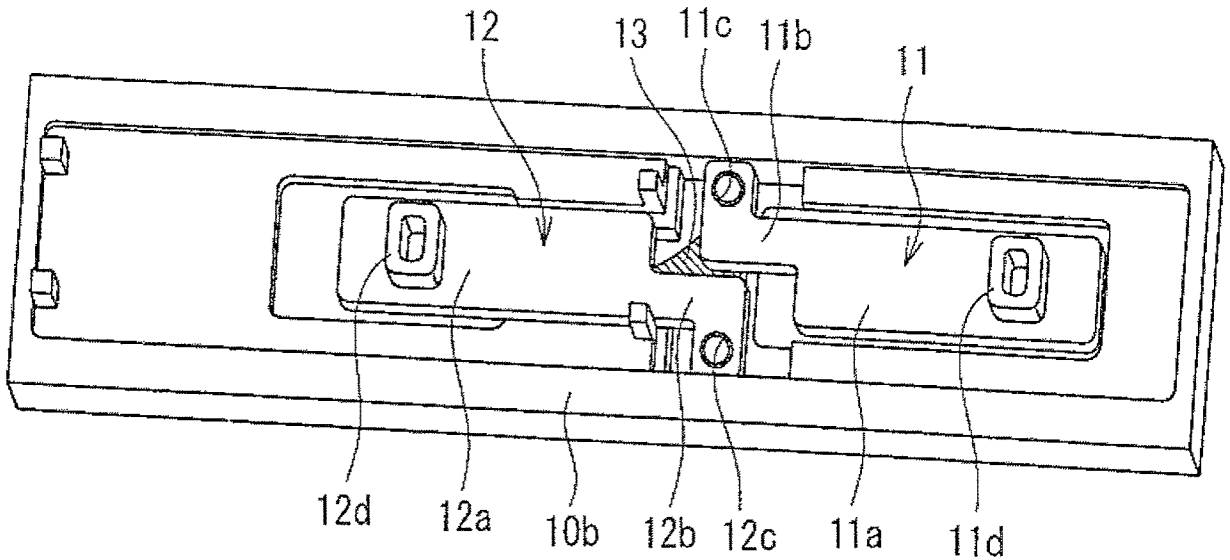
FIG. 4 shows the internal portion of the reversible unit according to the present invention.

As shown in FIG. 2(*a*), the reversible unit 10 includes a rectangular bottom plate 10*a* which is connected to arc extinguishing covers 2*a* and 2*b* (see FIG. 9) by being mounted over the two electromagnetic contactors 1*a* and 1*b*, a closed box-like unit frame 10*b* which is integrally attached to the peripheral edge portion of the bottom plate 10*a*, and, as shown in FIG. 4, a first interlock plate 11, a second interlock plate 12, and a lock piece 13 which are rotatably disposed in internal space of the bottom plate 10*a* and the unit frame 10*b* integrally attached to each other.

The bottom plate 10*a* is formed of a white synthetic resin material, and is formed with rectangular opening portions 10*c* and 10*d* at positions spaced apart in a longitudinal direction.

The unit frame 10*b* is formed of a white synthetic resin and, as shown in FIG. 2(*b*), is formed with a pair of rectangularly opened first display windows 10*e* and 10*f* at positions of a top plate 10*b*1 spaced apart in a longitudinal direction which correspond to the opening portions 10*c* and 10*d* of the bottom plate 10*a*, and also formed with a second display window 10*g* at a substantially middle position between the pair of first display windows 10*e* and 10*f*.

Figure 3:
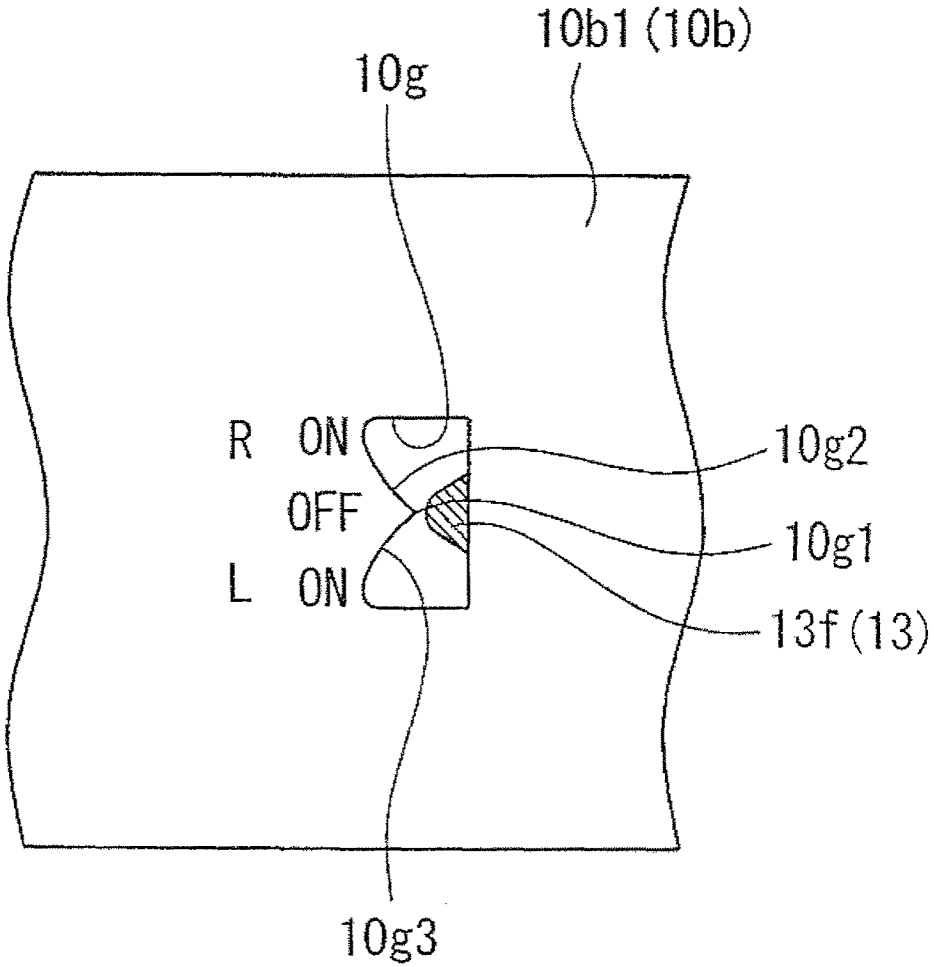
FIG. 3 shows the vicinity of a lock piece display window of the reversible unit according to the present invention.

As shown in FIG. 3, the second display window 10*g* is formed into a shape in which an opening peripheral wall positioned on one side in the longitudinal direction of the top plate 10*b*1 is formed to expand in a crest-like shape in a direction in which the opening area is reduced, and a first inclined peripheral wall 10*g*2 and a second inclined peripheral wall 10*g*3 extend toward a peripheral wall top portion 10*g*1 at the substantially same inclination angle.

Letters "OFF" are inscribed on the surface of the top plate 10*b*1 near the peripheral wall top portion 10*g*1, letters "R ON" (R is an initial of Right) are inscribed on the surface of the top plate 10*b*1 on the side of the first inclined peripheral wall 10*g*2 above the letters "OFF", and letters "L ON" (L is an initial of Left) are inscribed on the surface of the top plate 10*b*1 on the side of the second inclined peripheral wall 10*g*3 below the letters "OFF".

As shown in FIG. 4, the first interlock plate 11 includes a bend portion 11*b* which is formed at one end of an elongated portion 11*a* in a longitudinal direction so as to be bent in an L shape, a pin engagement hole 11*c* which is formed at the tip portion of the bend portion 11*b*, a tubular connection piece 11*d* which is formed to protrude on one surface on the other end side of the elongated portion 11*a* in the longitudinal direction, and a reversible unit operation display piece 11*e* which is formed on the other surface on the other end side of the elongated portion 11*a*. Note that the reversible unit operation display piece 11*e* is not shown in FIG. 4, and is shown as a member positioned in the first display window 10*e* in FIGS. 1 and 2(*b*).

The second interlock plate 12 is a member having the same shape as that of the first interlock plate 11, and includes a bend portion 12*b* which is formed at one end of an elongated portion 12*a* in a longitudinal direction so as to be bent in the L shape, a pin engagement hole 12*c* which is formed at the tip portion of the bend portion 12*b*, a tubular connection piece 12*d* which is formed to protrude on one surface on the other end side of the elongated portion 12*a* in the longitudinal direction, and a reversible unit operation display piece 12*e* which is formed on the other surface on the other end side of the elongated portion 12*a*. The reversible unit operation display piece 12*e* is also not shown in FIG. 4, and is shown as a member positioned in the first display window 10*f* in FIGS. 1 and 2(*b*).

Figure 5:
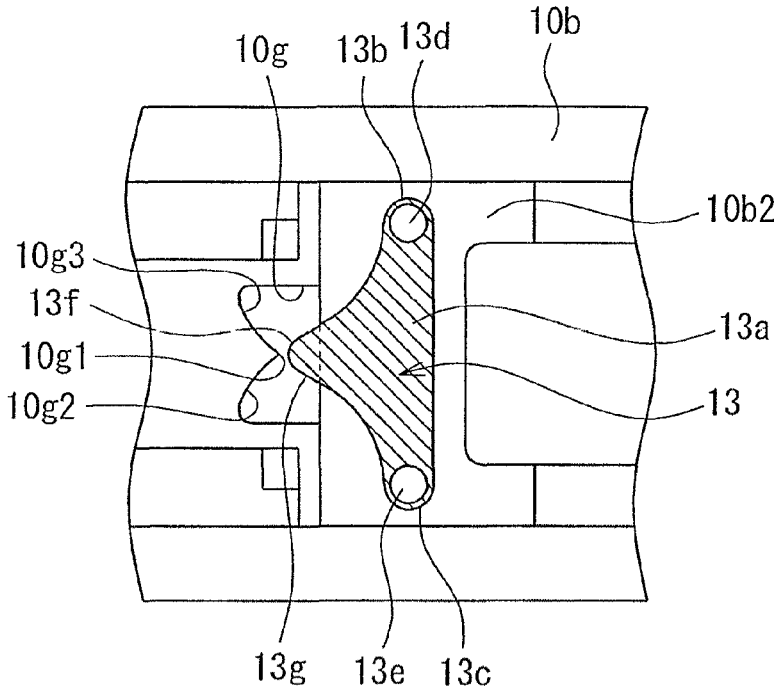
FIGS. 5(*a*) and 5(*b*) show a lock piece constituting the reversible unit according to the present invention.
Figure 5:
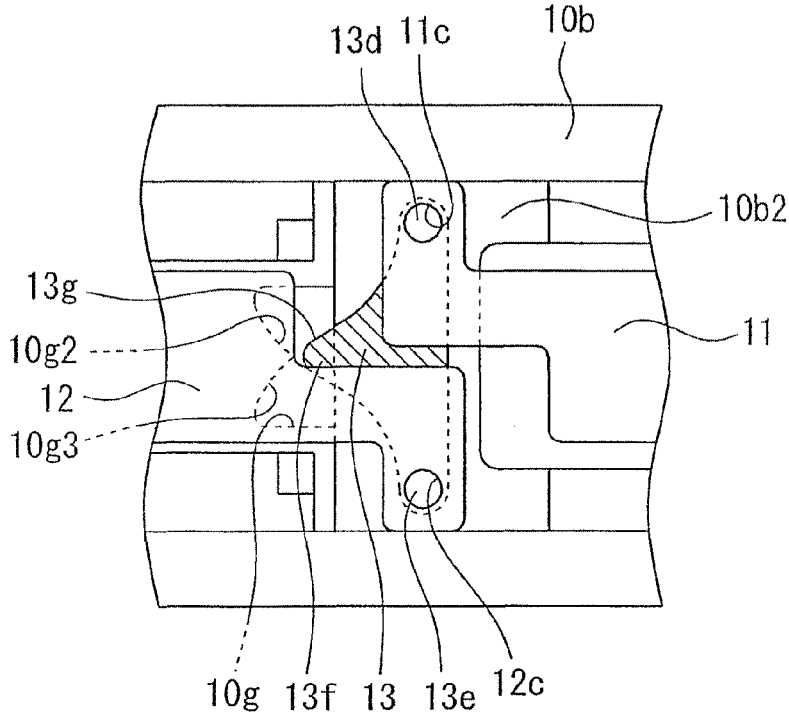

As shown in FIG. 5(*a*), the lock piece 13 is a member including a plate-like main body 13*a* which is formed of a black synthetic resin and has a substantially triangular shape in a plan view, and rotation pins 13*d* and 13*e* which protrude in the same direction from side surfaces near a first top portion 13*b* and a second top portion 13*c* of the plate-like main body 13*a*, and the lock piece 13 is rotatably disposed in an accommodation concave portion 10*b*2 provided between the unit frame 10*b* and the bottom plate 10*a*.

Herein, as shown in FIGS. 2 and 3, a third top portion 13*f* of the plate-like main body 13*a* is visible from the outside through the second display window 10*g*. In addition, the peripheral surface of the third top portion 13*f* in a thickness direction serves as a lock surface 13*g* which is engaged with the first inclined peripheral wall 10*g*2 and the second inclined peripheral wall 10*g*3 of the second display window 10*g*.

Further, as shown in FIG. 5(*b*), the rotation pin 13*d* of the lock piece 13 disposed in the accommodation concave portion 10*b*2 is connected to the pin engagement hole 11*c* of the first interlock plate 11 using the pin, and the rotation pin 13*e* of the lock piece 13 is connected to the pin engagement hole 12*c* of the second interlock plate 12 using the pin, whereby the first and second interlock plates 11 and 12 connected to each other via the lock piece 13 are disposed in the longitudinal direction in the unit frame 10*b*. In addition, as shown in FIG. 2(*b*), the reversible unit operation display pieces 11*e* and 12*e* of the first and second interlock plates 11 and 12 are positioned in the first display windows 10*e* and 10*f* formed in the top plate 10*b*1 of the unit frame 10*b*, the connection pieces 11*d* and 12*d* of the first and second interlock plates 11 and 12 are caused to protrude to the outside through the opening portions 10*c* and 10*d* formed in the bottom plate 10*a* as shown in FIG. 2(*a*), and the peripheral edge portions of the bottom plate 10*a* and the unit frame 10*b* are integrally attached to each other, whereby the reversible unit 10 is assembled.

In the reversible unit 10 having the above-described structure, the connection pieces 11*d* and 12*d* of the first and second interlock plates 11 and 12 which protrude to the outside from the opening portions 10*c* and 10*d* in the bottom plate 10*a* are connected to the head portions of the operation display pieces 4*a* and 4*b* (see FIG. 9) of the two adjacently disposed electromagnetic contactors 1*a* and 1*b* in fitting relation.

Note that a unit case of the present invention corresponds to the unit frame 10*b*, a lock piece display window of the present invention corresponds to the second display window 10*g*, and a prevention wall of the present invention corresponds to the first inclined peripheral wall 10*g*2 and the second inclined peripheral wall 10*g*3.

Figure 6:
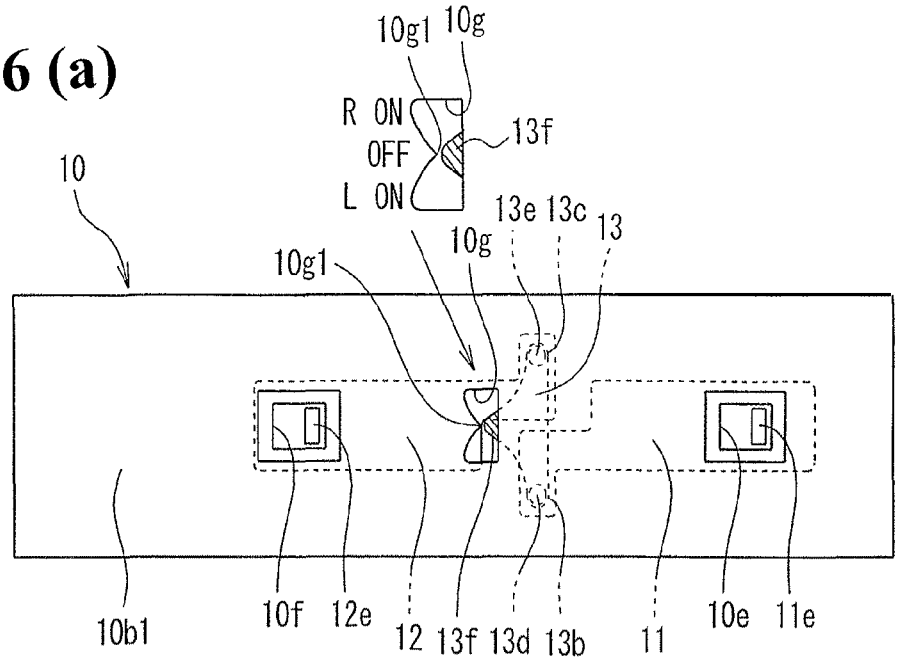
FIGS. 6(*a*) and 6(*b*) show the operation of the reversible unit according to the present invention when a pair of electromagnetic contactors is in a release state.
Figure 6:
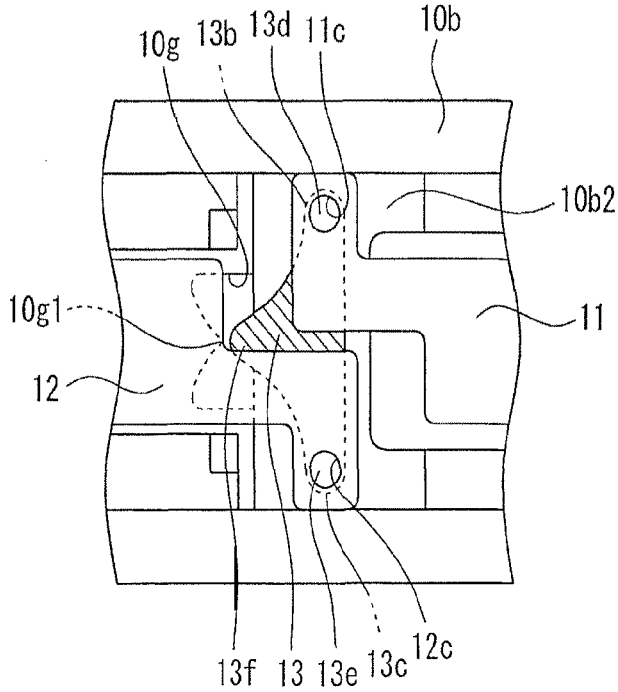
Figure 7:
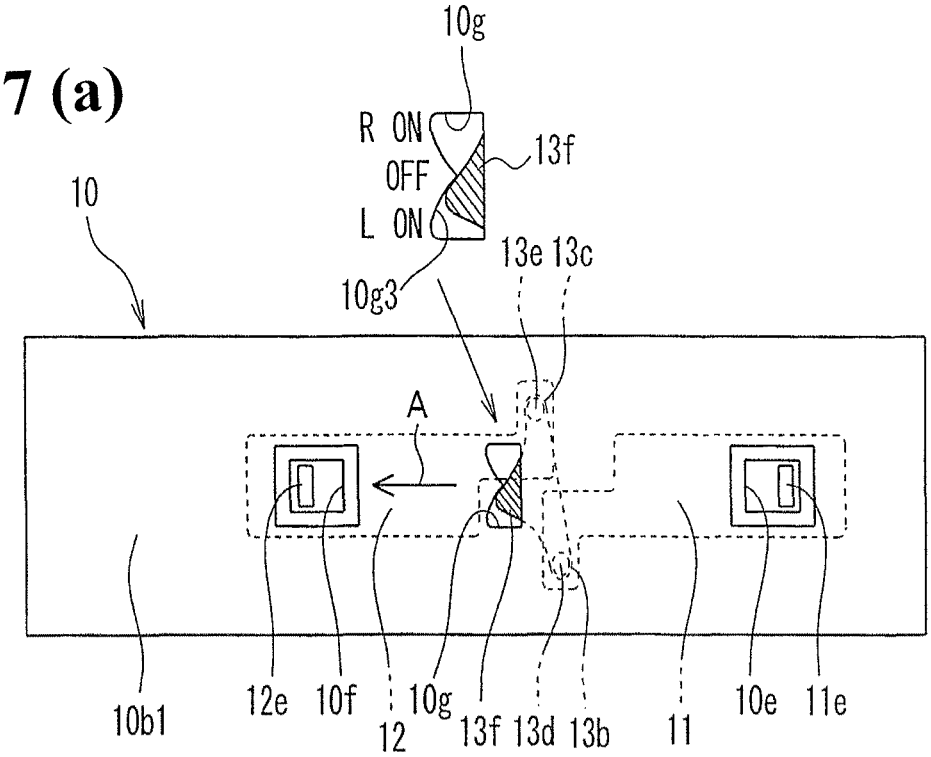
FIGS. 7(*a*) and 7(*b*) show the operation of the reversible unit according to the present invention when one of the pair of electromagnetic contactors is in a turned-on state, and the other one of the pair of electromagnetic contactors is in the release state.
Figure 7:
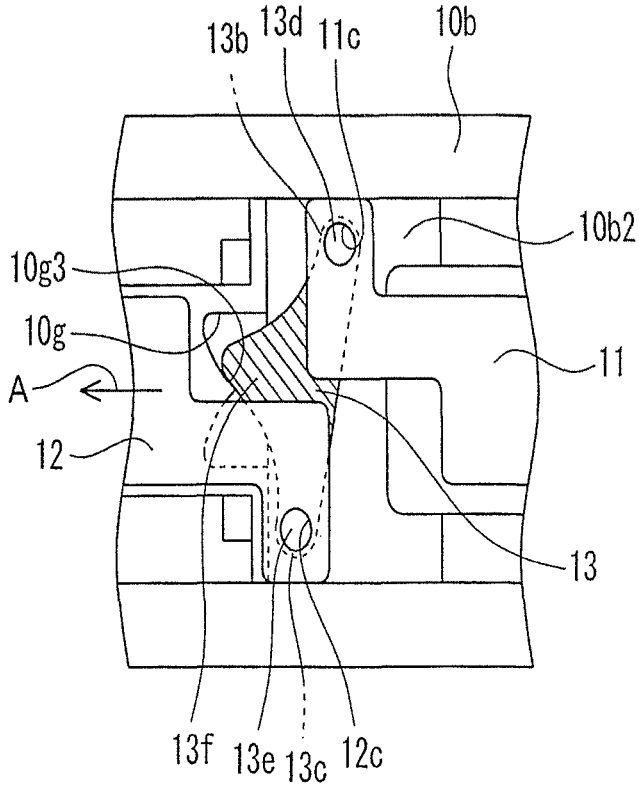
Figure 8:
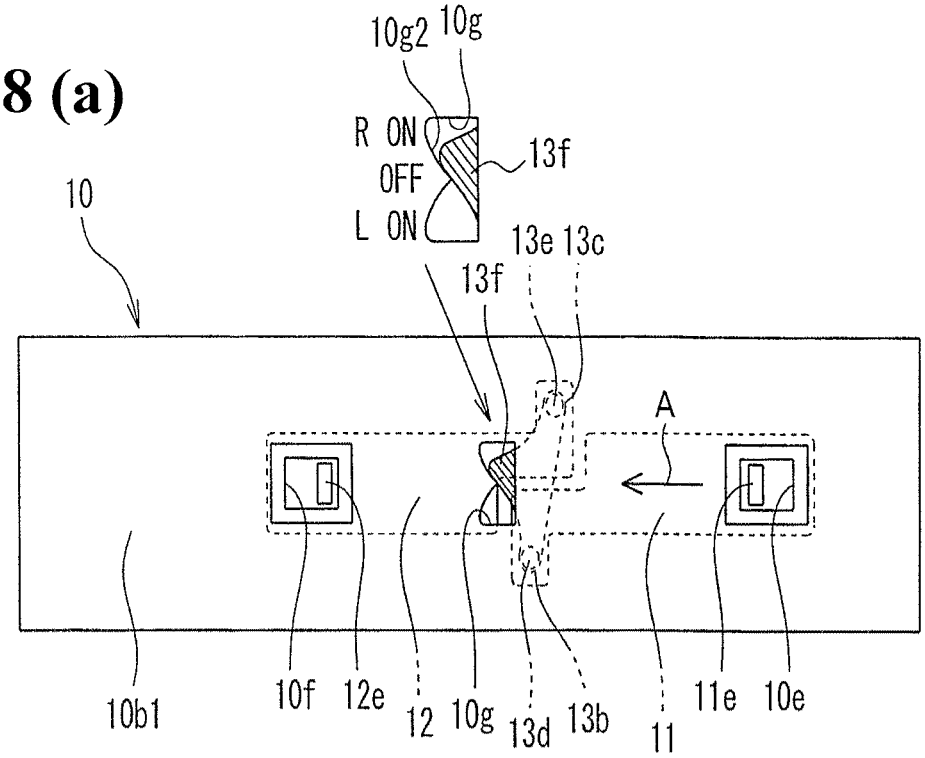
FIGS. 8(*a*) and 8(*b*) show the operation of the reversible unit according to the present invention when one of the pair of electromagnetic contactors is in the release state, and the other one of the pair of electromagnetic contactors is in the turned-on state.
Figure 8:
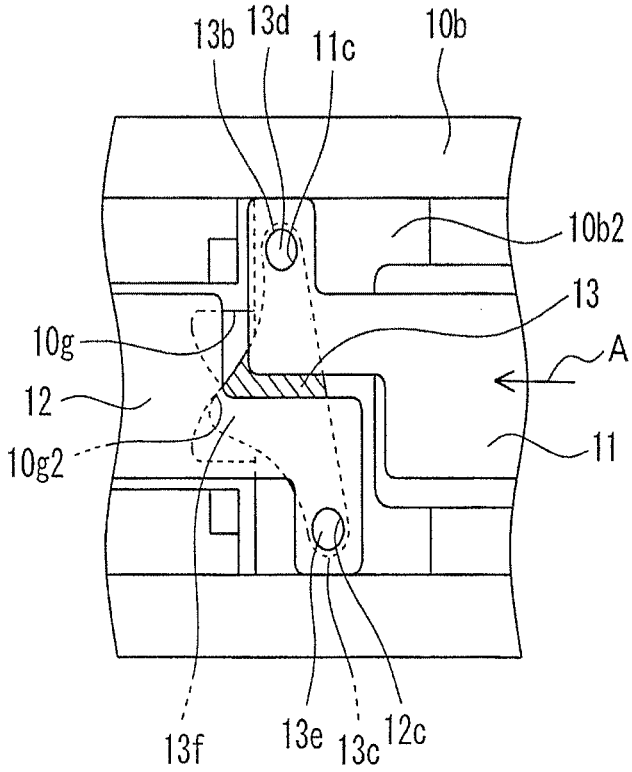

Next, FIGS. 6 to 8 show the operations of the reversible unit 10 attached by being mounted over the two electromagnetic contactors 1*a* and 1*b* (the electromagnetic contactor 1*a* is referred to as the right (R) electromagnetic contactor 1*a*, while the electromagnetic contactor 1*b* is referred to as the left (L) electromagnetic contactor 1*b*).

Each of FIGS. 6(*a*) and 6(*b*) shows the operation of the reversible unit 10 when both of the right electromagnetic contactor 1*a* and the left electromagnetic contactor 1*b* are in an open (OFF) state (release state).

Figure 9:
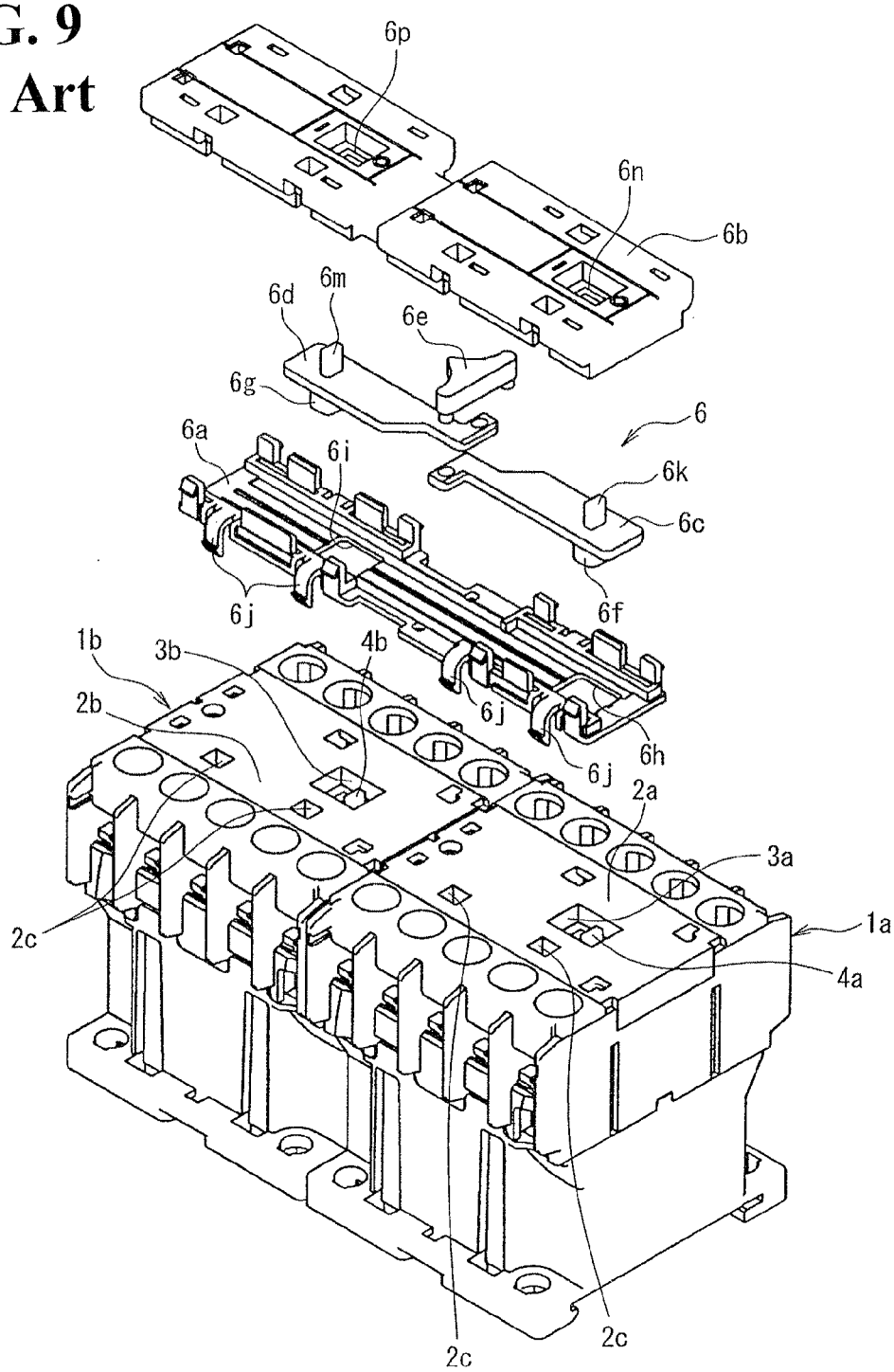
FIG. 9 Prior Art
FIG. 9 is an exploded perspective view showing a conventional reversible electromagnetic contactor.
Figure 10:
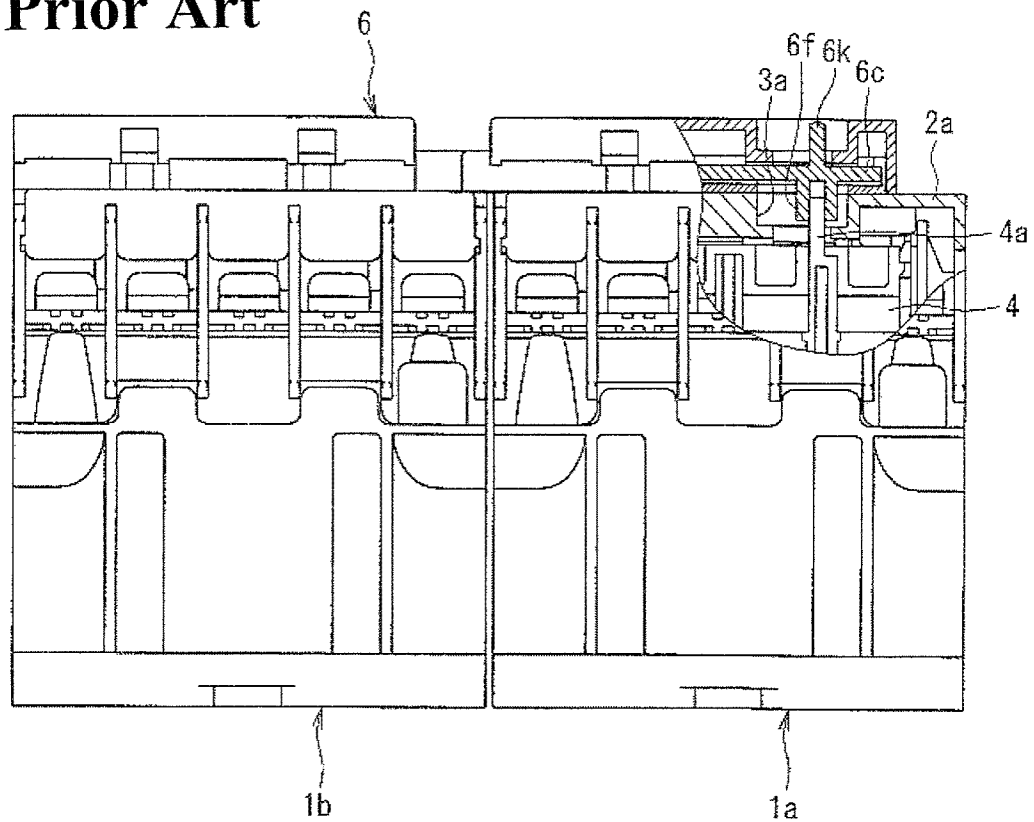
FIG. 10 Prior Art
FIG. 10 is a cross-sectional view of the principal portion of the conventional reversible electromagnetic contactor when viewed from its side portion.

In the electromagnetic contactors 1*a* and 1*b* in the release state, the operation display pieces 4*a* and 4*b* are positioned at the right sides of the display windows 3*a* and 3*b* (see FIG. 9)

so that the first and second interlock plates 11 and 12 of the reversible unit 10 having the connection pieces 11*d* and 12*d* connected to the operation display pieces 4*a* and 4*b* are disposed such that the reversible unit operation display pieces 11*e* and 12*e* are positioned at the right sides of the first display windows 10*e* and 10*f*.

In the lock piece 13 of the reversible unit 10 which is held at the first and second interlock plates 11 and 12 via the pin connection positions (the rotation pin 13*d* and the pin engagement hole 11*c*, the rotation pin 13*e* and the pin engagement hole 12*c*), the third top portion 13*f* is caused to oppose the peripheral wall top portion 10*g*1 of the second display window 10*g*.

As shown in FIG. 6(*a*), the letters "OFF" are inscribed on the surface of the top plate 10*b*1 near the peripheral wall top portion 10*g*1 and, when the second display window 10*g* is viewed from the outside, the third top portion 13*f* opposing the peripheral wall top portion 10*g*1 indicates "OFF".

Each of FIGS. 7(*a*) and 7(*b*) shows the operation of the reversible unit 10 when the left electromagnetic contactor 1*b* is in a close (ON) state (turned-on state), and the right electromagnetic contactor 1*a* is in the open (OFF) state (release state).

In the left electromagnetic contactor 1*b* in the turned-on state, the operation display piece 4*b* moves from the right side of the display window 3*b* to the left side thereof so that the second interlock plate 12 of the reversible unit 10 having the connection piece 12*d* connected to the operation display piece 4*b* moves in an arrow A direction shown in FIG. 7(*a*) from the position of FIG. 6(*a*). On the other hand, in the right electromagnetic contactor 1*a* in the release state, the operation display piece 4*a* is positioned at the right side of the display window 3*a* so that the first interlock plate 11 of the reversible unit 10 having the connection piece 11*d* connected to the operation display piece 4*a* does not move (the same position as that shown in FIG. 6(*a*)).

At this point, the second top portion 13*c* side (the rotation pin 13*e* side) of the lock piece 13 of the reversible unit 10 rotates about the rotation pin 13*d* engaged with the pin engagement hole 11*c* of the first interlock plate 11 in the arrow A direction together with the second interlock plate 12, and the lock surface 13*g* as the peripheral surface of the third top portion 13*f* in the thickness direction contacts with the second inclined peripheral wall 10*g*3 of the second display window 10*g*.

As shown in FIG. 7(*a*), the letters "L ON" are inscribed on the surface of the top plate 10*b*1 near the second inclined peripheral wall 10*g*3 and, when the second display window 10*g* is viewed from the outside, the third top portion 13*f* indicates "L ON".

Herein, the lock surface 13*g* of the third top portion 13*f* contacts with the second inclined peripheral wall 10*g*3 of the second display window 10*g*, and the rotation of the rotation pin 13*d* side of the lock piece 13 in the arrow A direction is thereby prevented so that the first interlock plate 11 can not move in the arrow A direction together with the second interlock plate 12.

Each of FIGS. 8(*a*) and 8(*b*) shows the operation of the reversible unit 10 when the right electromagnetic contactor 1*a* is in the close (ON) state (turned-on state), and the left electromagnetic contactor 1*b* is in the open (OFF) state (release state).

In the right electromagnetic contactor 1*a* in the turned-on state, the operation display piece 4*a* moves from the right side of the display window 3*a* to the left side thereof so that the first interlock plate 11 of the reversible unit 10 having the connection piece 11*d* connected to the operation display piece 4*a* moves in the arrow A direction shown in FIG. 8(*a*) from the position of FIG. 6(*a*). On the other hand, in the left electromagnetic contactor 1*b* in the release state, the operation display piece 4*b* is positioned at the right side of the display window 3*b* so that the second interlock plate 12 of the reversible unit 10 having the connection piece 12*d* connected to the operation display piece 4*b* does not move (the same position as that shown in FIG. 6(*a*)).

At this point, the first top portion 13*b* side (the rotation pin 13*d* side) of the lock piece 13 of the reversible unit 10 rotates about the rotation pin 13*e* engaged with the pin engagement hole 12*c* of the first interlock plate 11 in the arrow A direction together with the first interlock plate 11, and the lock surface 13*g* of the third top portion 13*f* contacts with the first inclined peripheral wall 10*g*2 of the second display window 10*g*.

As shown in FIG. 8(*a*), the letters "R ON" are inscribed on the surface of the top plate 10*b*1 near the first inclined peripheral wall 10*g*2 and, when the second display window 10*g* is looked at from the outside, the third top portion 13*f* indicates "R ON".

Herein, the lock surface 13*g* of the third top portion 13*f* contacts with the first inclined peripheral wall 10*g*2 of the second display window 10*g*, and the rotation of the rotation pin 13*d* side of the lock piece 13 in the arrow A direction is thereby prevented so that the second interlock plate 12 cannot move in the arrow A direction together with the first interlock plate 11.

Next, a description is given of the effect of the reversible electromagnetic contactor provided with the reversible unit 10 having the above-described structure.

As shown in FIG. 7(*a*), when the left electromagnetic contactor 1*b* is brought into the turned-on state, the second interlock plate 12 of the reversible unit 10 moves in the arrow A direction, and the third top portion 13*f* (the lock surface 13*g*) of the lock piece 13 of the reversible unit 10 thereby contacts with the second inclined peripheral wall 10*g*3 of the second display window 10*g*. With this, since the movement of the first interlock plate 11 of the reversible unit 10 in the arrow A direction is prevented, it is possible to reliably prevent the right electromagnetic contactor 1*a* in the release state having the operation display piece 4*a* connected to the connection piece 11*d* of the first interlock plate 11 from being brought into the turned-on state. In addition, as shown in FIG. 8(*a*), when the right electromagnetic contactor 1*a* is brought into the turned-on state, the first interlock plate 11 moves in the arrow A direction, and the third top portion 13*f* (the lock surface 13*g*) of the lock piece 13 thereby contacts with the first inclined peripheral wall 10*g*2 of the second display window 10*g*. With this, since the movement of the second interlock plate 12 in the arrow A direction is prevented, it is possible to reliably prevent the left electromagnetic contactor 1*b* in the release state having the operation display piece 4*b* connected to the connection piece 12*d* of the second interlock plate 12 from being brought into the turned-on state.

Consequently, since the reversible unit 10 of the present embodiment has the structure in which, when one of the two electromagnetic contactors 1*a* and 1*b* is brought into the turned-on state, the lock piece 13 rotates with the movement of one of the first and second interlock plates 11 and 12, the third top portion 13*f* of the lock piece 13 contacts with one of the first and second inclined peripheral walls 10*g*2 and 10*g*3 of the second display window 10*g*, and the movement of the other one of the first and second interlock plates 11 and 12 connected to the other one of the electromagnetic contactors 1*a* and 1*b* which is in the release state is prevented, it is possible to reliably prevent the two electromagnetic contactors 1*a* and 1*b* from being simultaneously brought into the turned-on state.

In addition, in the case where the third top portion 13*f* of the lock piece 13 indicates "OFF" inscribed on the top plate 10*b*1 when the second display window 10*g* of the reversible unit 10 is viewed (see FIG. 6(*a*)), it is possible to determine that both of the right electromagnetic contactor 1*a* and the left electromagnetic contactor 1*b* are in the release state. On the other hand, in the case where the third top portion 13*f* of the lock piece 13 indicates "L ON" inscribed on the top plate 10*b*1 (see FIG. 7(*a*)), it is possible to determine that only the left electromagnetic contactor 1*b* is in the turned-on state and, in the case where the third top portion 13*f* of the lock piece 13 indicates "R ON" inscribed on the top plate 10*b*1 (see FIG. 8(*a*)), it is possible to determine that only the right electromagnetic contactor 1*a* is in the turned-on state. Accordingly, it is possible to easily determine the release state or the turned-on state of each of the two electromagnetic contactors 1*a* and 1*b*.

Therefore, in an induction motor in which the reversible electromagnetic contactor of the present embodiment is connected to a feeder circuit, only by looking at the direction indicated by the third top portion 13*f* of the lock piece 13 through the second display window 10*g* of the reversible unit 10, it is possible to easily determine the forward operation or the reverse operation of the induction motor.

In addition, since the unit frame 10*b* formed with the second display window 10*g* (the top plate 10*b*1) is formed of, e.g., the white synthetic resin, and the lock piece 13 (the third top portion 13*f*) visible through the second display window 10*g* is formed of the black synthetic resin in a contrasting color, it is possible to visually identify the direction of "OFF", "L ON", or "R ON" indicated by the third top portion 13*f* with accuracy.

Further, the second display window 10*g* formed in the unit frame 10*b* is not only for displaying the third top portion 13*f* of the lock piece 13, but is formed into the shape in which the opening peripheral wall positioned on one side in the longitudinal direction expands in the crest-like shape in the direction in which the opening area is reduced, and the first and second inclined peripheral walls 10*g*2 and 10*g*3 extend toward the peripheral wall top portion 10*g*1 at the substantially same inclination angle, and forms the prevention wall which prevents the movement of the first interlock plate 11 by the contact of the third top portion 13*f* (the lock surface 13*g*) with the second inclined peripheral wall 10*g*3, and prevents the movement of the second interlock plate 12 by the contact of the third top portion 13*f* (the lock surface 13*g*) with the first inclined peripheral wall 10*g*2.

Thus, in the present embodiment, since the opening peripheral wall (the first and second inclined peripheral walls 10*g*2 and 10*g*3) of the second display window 10*g* which displays the third top portion 13*f* of the lock piece 13 functions as the prevention wall to the first and second interlock plates 11 and 12, it is possible to provide the inexpensive reversible unit 10 having the simple structure without adding special components or adopting a complicated structure.

In the present embodiment, although the unit frame 10*b* has been formed as the white member and the lock piece 13 has been formed as the black member, even when the unit frame 10*b* is formed as the black member and the lock piece 13 is formed as the white member, it is possible to visually identify the direction of "OFF", "L ON", or "R ON" indicated by the third top portion 13*f* with accuracy. In addition, the member is not limited to the white member or the black member, and even when the unit frame 10*b* and the lock piece 13 in opposite colors are formed, it is possible to visually identify the direction of "OFF", "L ON", or "R ON" indicated by the third top portion 13*f* with accuracy.

INDUSTRIAL APPLICABILITY

Thus, the reversible electromagnetic contactor according to the present invention is useful for easily determining which one of the two electromagnetic contactors is in the turn-on operation.

EXPLANATION OF REFERENCE NUMERALS

1*a* . . . right electromagnetic contactor, 1*b* . . . left electromagnetic contactor, 2*a*, 2*b* . . . arc extinguishing cover, 3*a*, 3*b* . . . display window, 4*a*, 4*b* . . . operation display piece, 10 . . . reversible unit, 10*a* . . . bottom plate, 10*b* . . . unit frame, 10*b*1 . . . top plate, 10*b*2 . . . accommodation concave portion, 10*c*, 10*d* . . . opening portion, 10*e*, 10*f* . . . first display window, 10*g* . . . second display window, 10*g*1 . . . peripheral wall top portion, 10*g*2 . . . first inclined peripheral wall, 10*g*3 . . . second inclined peripheral wall, 11 . . . first interlock plate, 11*a* . . . elongated portion, 11*b* . . . bend portion, 11*c* . . . pin engagement hole, 11*d* . . . connection piece, 11*e* . . . reversible unit operation display piece, 12 . . . second interlock plate, 12*a* . . . elongated portion, 12*b* . . . bend portion, 12*c* . . . pin engagement hole, 12*d* . . . connection piece, 12*e* . . . reversible unit operation display piece, 13 . . . lock piece, 13*a* . . . plate-like main body, 13*b* . . . first top portion, 13*c* . . . second top portion, 13*d*, 13*e* . . . rotation pin, 13*f* . . . third top portion, 13*g* . . . lock surface, "R ON" . . . first display portion, "L ON" . . . second display portion

What is claimed is:

1. A reversible electromagnetic contactor in which a pair of electromagnetic contactors is adjacently disposed to move respective operation display pieces protruding on upper surfaces in an identical direction in a turn-on operation, and a reversible unit is attached to mount over the upper surfaces of the pair of electromagnetic contactors, wherein the reversible unit comprises a pair of interlock plates detachably connected to the operation display pieces of the pair of electromagnetic contactors, a lock piece which is connected between the pair of interlock plates, and a unit case accommodating the pair of interlock plates and the lock piece, and being attached to mount over the upper surfaces of the pair of electromagnetic contactors, the lock piece rotates in a first direction as one of the interlock plates moves in the turn-on operation of one of the electromagnetic contactors and prevents a movement of the other interlock plate to maintain a release operation of the other electromagnetic contactor, and said lock piece rotates in a second direction different from the first direction by the movement of the other interlock plate in the turn-on operation of the other electromagnetic contactor and prevents a movement of the one of the interlock plates to maintain the release operation of the one of the electromagnetic contactors, wherein the unit case is provided with a lock piece display window to confirm rotation of the lock piece in the first direction or the second direction, and wherein the lock piece is a plate-shaped member having a substantially triangular shape in a plan view, each of a first top portion and a second top portion of the lock piece is rotatably connected to an end portion in a movement direction of each of the pair of interlock plates, and a third top portion of the lock piece is displayed to an outside from the lock piece display window, and an opening peripheral wall forming the lock piece display window is formed with a prevention wall to prevent the movement of the other interlock plate or the one of the interlock plates by contacting with a lock surface as a peripheral surface of the third top portion when the lock piece rotates in the first direction or the second direction.

2. A reversible electromagnetic contactor according to claim 1, wherein a surface of the unit case around the lock piece display window comprises:

a first display portion displaying the one of the electromagnetic contactors in the turned-on state in a rotating direction of the lock piece in the first direction, and a second display portion showing the other of the electromagnetic contactors in the turned-on state in a rotating direction of the lock piece in the second direction.

3. A reversible electromagnetic contactor according to claim 1, wherein the unit case and the lock piece are formed of members having different colors.

* * * * *